US006131311A

United States Patent [19]

Brown et al.

[11] Patent Number: 6,131,311

[45] Date of Patent: Oct. 17, 2000

[54] INSOLE INSERT FOR FOOTWEAR

[75] Inventors: James G. Brown, Lawrence; Terry D. Blackwell, Topeka, both of Kans.

[73] Assignee: Payless ShoeSource, Inc., Topeka, Kans.

[21] Appl. No.: 09/061,924

[22] Filed: Apr. 17, 1998

[51] Int. Cl.[7] ..... A43B 13/38; A43B 19/00

[52] U.S. Cl. ..... 36/43; 36/91; 36/44; 36/145; 36/166; 36/173

[58] Field of Search ..... 36/88, 91, 93, 36/94, 95, 112, 43, 44, 92, 140, 145, 166, 173, 174, 176

[56] References Cited

U.S. PATENT DOCUMENTS

| | | | |
|---|---|---|---|
| 975,576 | 11/1910 | Sexton | 36/43 |
| 1,960,418 | 5/1934 | Schaller | 36/44 |
| 2,909,854 | 10/1959 | Edelstein | 36/44 |
| 2,961,780 | 11/1960 | McManus | 36/71 |
| 4,003,146 | 1/1977 | Meier et al. | 36/44 |
| 4,435,910 | 3/1984 | Marc | 36/44 |
| 4,759,357 | 7/1988 | Allart et al. | 36/44 |
| 5,544,432 | 8/1996 | Kita | 36/43 |

*Primary Examiner*—M D Patterson
*Attorney, Agent, or Firm*—Lathrop & Gage L.C.

[57] ABSTRACT

An insole insert comprises a body having a bottom portion, a heel edge, a lateral side edge, a medial side edge, a depression portion spaced generally centrally beneath the user's first metatarsal phalangeal joint, a heel portion formed along the heel lateral side edges and extending forwardly to just rearwardly of the user's fifth metatarsal phalangeal joint, and an arch portion formed along the medial side edge and extending forwardly to just rearwardly of the depression portion. The heel portion and the arch portion, which form a channel that is laterally angularly offset relative to the insole insert, are configured to cooperatively redistribute the normally greater weight-generated forces applied to the inner and more bony regions of the user's heel outwardly toward the outer and more fleshy regions of the user's heel. The bottom portion, the depression portion, the heel portion, and the arch portion are configured to cooperatively redistribute weight-generated forces operatively bearing against the sole of the user's foot such that greater weight-generated forces normally bearing against certain regions of the arch and forefoot of the user's foot are substantially reduced and redistributed toward other regions whereat smaller weight-bearing forces normally bear against the sole of the user's foot.

1 Claim, 2 Drawing Sheets

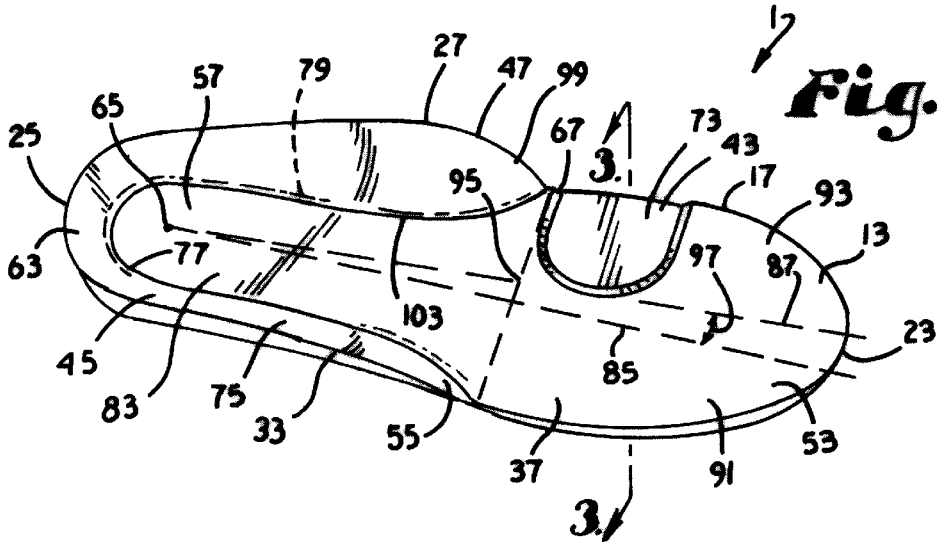
Fig. 2.
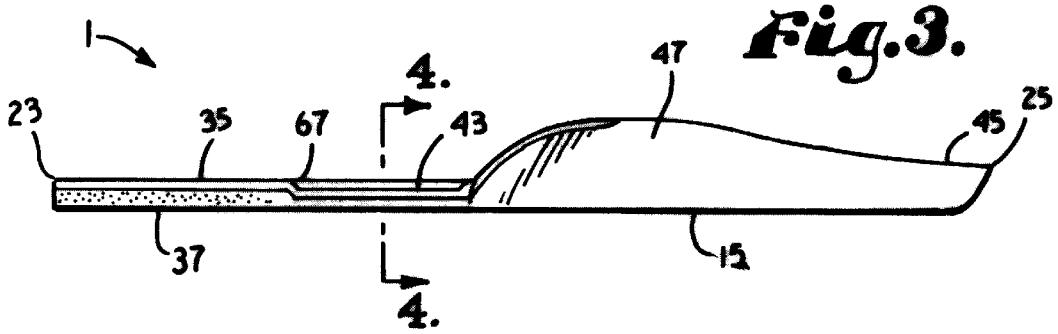
Fig. 3.
Fig. 4.
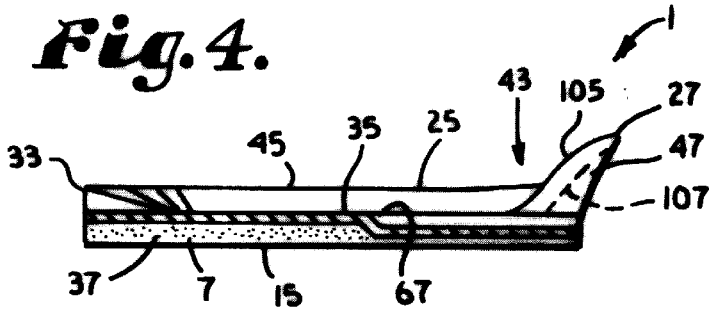

INSOLE INSERT FOR FOOTWEAR

BACKGROUND OF THE INVENTION

1. Field of the Invention

This invention relates generally to footwear and, more specifically without limitation, to an insole insert for children's footwear.

2. Description of the Related Art

Although children are usually born with normal arches, as a child begins to learn to walk and body weight is applied to his feet as they bear against a supporting surface, his foot structure necessarily reacts by tending to flatten out under the weight-generated forces applied to the soles of his feet. If the child were walking only on natural supporting surfaces, e.g., the ground, the normal age for the child to be able to stand without the need of external support for his feet is generally considered to be approximately eight years of age. For purposes of improved appearance, convenience, endurance, etc., however, man-made products are generally applied to those supporting surfaces. Unfortunately, such "improved" surfaces tend to be detrimental to the human musculoskeletal structures, especially during the developmental stages when the child's foot structure is "soft" and incompletely formed. Due to such negative environmental influences on the human foot structure, shoes which provide proper support and shock attenuation should be worn for protection and prevention of structural injury.

As disclosed in U.S. Pat. No. 4,272,899, issued Jun. 16, 1981 to Jeffrey S. Brooks, the disclosures and teachings of which are incorporated herein by reference, a contoured insole structure may be provided in children's shoes to reduce abnormal stress from the heel to the metatarsals by properly supporting and stabilizing the feet during development thereof. By so doing, the associated stresses placed upon the medial column of the foot is also reduced, distributing the body weight more evenly on the sole of the foot.

More specifically, when walking or running, the lateral (outside) portion of the heel is generally the first part of the foot to strike the ground, with the foot then pivoting on the heel to bring the lateral part of the forefoot into a position whereat it bears against an underlying surface. At that point, the foot resides in a supinated (inclined upwardly from the lateral to the medial side of the foot). The foot then pronates until all of the metatarsal heads are in the horizontal plane (flat to the supporting surface). The bone structural alignment should be firmly supported when the foot assumes such neutral position in order to prevent the ligaments, muscles and tendons of the foot from becoming over-stressed.

Various skeletal characteristics of the feet that are pertinent to proper foot support include the first, second, third, fourth and fifth metatarsal heads, indicated in phantom at M1 through M5 in FIG. 1; first, second, third, fourth and fifth metatarsal necks associated with the respective metatarsal heads M1–M5, indicated in phantom at N1 through N5; first, second, third, fourth and fifth proximal phalanges spaced distally from the respective metatarsal heads M1–M5, indicated in phantom at P1 through P5; and first, second, third, fourth and fifth metatarsal phalangeal joints spaced between the respective metatarsal heads M1–M5 and proximal phalanges P1–P5, indicated at J1 through J5 in FIG. 1. Further, various muscles and tendons characteristically interact to stabilize the foot during the sequence of progressive movements normally experienced in a walking or running gait in preparation for movement from the neutral position to a propulsive phase of the gait cycle, sometimes referred to as "toe-off" or "push-off".

Flexion of the first metatarsal phalangeal joint (i.e., the great toe joint) is normally approximately fifteen degrees to the associated metatarsal in a dorsiflex position when standing, and increases to between sixty-five and ninety degrees, depending on the available motion and the activity required by the joint just prior to lifting off the underlying supporting surface. The relationship among the foot bones is such that the first metatarsal phalangeal joint and the two small bones there beneath, the tibial sesamoid and the fibular sesamoid, should be displaced downwardly ("plantarflex") in order for the toe to function appropriately.

Thus the progressive phases of gait are heel strike, when the heel hits the ground; midstance, when stability of the arch is an essential necessity; and propulsive phase, as the heel lifts off the ground and the body weight shifts onto the ball of the foot. During the transition from the neutral position through toe-off, it is preferable that the second and third metatarsals be firmly supported, and that the first metatarsal head plantarflex (move downward) relative the second and third metatarsal heads. The toes also should generally be firmly supported during toe-off so that they remain straight, and thus stronger, promoting a "pillar effect" by the phalanges.

To provide additional insight into some of the mechanisms of the human feet, it is known that the lower limbs of the human embryo begin to rotate internally ninety degrees from an external position at the pelvic girdle at approximately the eighth week of fetal development. At the twelfth week of development, the feet begin to dorsiflex, and around the sixteenth week of development, the completely inverted feet begin to evert, all of which are part of the complex preparation of the lower extremity for upright, bi-pedal weight-bearing posture and locomotion. A child's feet and legs have sometimes been described as a loose bag of bones and cartilage floating in a mass of soft tissue until about age six. As a result, foot posture is a rapidly changing proposition for children under the age of six years. The true structure of a child's foot is not developed until approximately seven or eight years of age when development of the sustentaculum tali is generally complete. Further, eighty to ninety percent of the child's adult foot size is developed by the age of ten, with complete development occurring by approximately age 14–16 years in human females and age 15–17 years in human males.

When infants begin to bear weight, their feet begin to pronate excessively because their feet are not yet ready, without deformation, to be placed on an unnatural surface, such as a hard flat surface. As a result, if uncorrected, repeated weight-generated forces may cause these early weight-bearing feet to permanently deform (excessive pronation). Thus, such early-age, weight-bearing feet should preferably be maintained in proper postural alignment by providing a more natural environment therefor, such as a better supporting interface between the feet and the underlying supporting surfaces thereby allowing the feet to develop as normally as possible during their postnatal development.

Therefore, as soon as the child begins to bear weight on his feet, usually around six to seven months of age, treatment to neutralize excessive pronation should be instituted. The user's feet should be placed in their individually most efficient position to function properly and to reduce excessive strain not only on the feet but also on the lower body structure supported by the feet. In an ideal foot posture situation for minimal stress, and the position in which the feet as weight-bearing organs would normally realize greatest efficiency (including an optimal ratio of supination and pronation) is one in which the subtalar joint is approximately forty-two degrees from the transverse plane, approximately sixteen degrees from the saggital plane, and approximately forty-eight degrees from the frontal plane, sometimes referred to as the neutral position hereinbefore mentioned. In the neutral position, the leg and calcaneus are perpendicular to the weight bearing surface, and the knee joint, ankle joint and forefoot, including the plane of the metatarsal heads, are substantially parallel to the subtalar joint and to the walking surface.

A fully developed human foot can generally be described as having one of three basic types: normal, low arch ("flat foot"), or high arch. From an anatomical standpoint, normal and flat feet are capable of being functionally controlled by the same basic shoe control mechanism, while a high-arch foot is structurally different and may require a different supporting environment. For example, the amount of adduction ("pigeon-toedness") of the front part of a normal or flat foot in relation to the heel area of the foot is typically slight, while the amount of adduction in a high-arch foot is generally much greater. Further, the movement of a normal or flat foot during running is also substantially different from that of a high-arch foot. If proper support and stabilization is not properly implemented during their early formative development, fully developed feet may be more susceptible to, and be more prone to suffer from, various maladies, including the following:

(a) tearing of the plantar fascia tissues which connect the heel to the ball of the foot and support the arch of the foot, sometimes referred to as "plantar fascial tears" or "plantar fasciitis", which generally arise from stressful upward pulls on the calcaneus ("heel bone") and strain of the intrinsic or interior foot muscles, and is generally realized as heel pain;

(b) excessive stress between adjacent metatarsals, sometimes referred to as "metatarsal stress fractures", generally arising from improper support of the talonavicular joint ("arch") and instability of the first ray ("great toe joint");

(c) irritation of the tissue associated with a small bone beneath the great toe joint, sometimes referred to as "tibial sesamoiditis", generally arising from inappropriate support of the talonavicular joint and/or inappropriate weight distribution between the various metatarsal phalangeal joints;

(d) excessive bony growth on the top of the foot, sometimes referred to as "saddle joint deformity", generally arising from improper movement of the first metatarsal and realized in the form of degenerative arthritis;

(e) inflammation and/or separation of tissue from the tibia, sometimes referred to as "shin splint", generally arising from improper articulation of the talonavicular joint between the ankle bone and the key supporting bone of the foot and generally realized as fatigue of the muscles in the front and back of the leg; and (f) bruising in the bottom center of the heel generally arising from disproportionally greater weight-generated forces applied thereto.

Such maladies should be given due consideration, both in youth and in adults, as the human foot may start to breakdown as a result of degenerative disease by the age of thirty-five years.

In view of the foregoing, it should be obvious that certain parts of the feet are generally subjected to higher stresses during standing, running and walking, and that other parts of the feet require different degrees of support for maximum biomechanical efficiency, particularly since high impact forces to the foot are generally transferred to other skeletal structures, such as the shins, knees, and lower back region.

In conventional children's shoes, the insole is generally either rigidly planar or has a "cookie" disposed in the arch. Control of the user's foot, however, must begin in the heel and proceed to the arch, including providing stability of the forefoot in order for the foot to function properly through the normal phases of gait. Various devices have been developed in attempts to provide needed support and stabilization for a child's feet. A frequent problem with most of such devices made for children, however, is getting the devices to not only properly fit the child's feet but, in the case of insole inserts, to also fit the child's shoes while properly supporting and stabilizing the child's feet.

Thus, what is needed is a device, when placed into footwear, provides an appropriate amount of support and shock attenuation for different regions of the foot to thereby provide a proper environment that promotes a balanced foot position for healthy postural and skeletal structural development each time the child takes another step, thus allowing the parts of the foot to function in a way which provides maximum efficiency, to prepare the body for stresses normally subjected thereto, and to protect those parts of the foot which are subjected to high impact forces.

SUMMARY OF THE INVENTION

An improved insole insert, integrally formed from a resilient material, is provided for redistributing the weight-generated forces applied to the sole of the wearer's foot while simultaneously providing firm support for the foot, for attenuating the shock of impact to the wearer thereof during running or walking, and for properly supporting and stabilizing the wearer's foot throughout the various supported phases of the user's gait.

The insole insert comprises a body having a toe edge, a heel edge, a lateral side edge, a medial side edge, and a bottom portion, wherein the bottom portion includes a front section extending rearwardly from the toe edge to just rearwardly from the metatarsal phalangeal joints of the user, with the front section having a substantially uniform thickness. The bottom portion also includes a rear section extending rearwardly from the front section to the heel portion, with the rear section having substantially the same thickness as the front section at a juncture therewith and gradually increasing in thickness rearwardly from the front section.

The insole insert further comprises a depression portion formed in the body and spaced generally centrally beneath the first metatarsal phalangeal joint of the user, with the depression area preferably having a tapered perimetral edge. The insole insert also includes a heel portion, formed along the heel edge and the lateral side edge and extending forwardly to a foremost end thereof spaced just rearwardly of the user's fifth metatarsal phalangeal joint, and an arch portion formed along the medial side edge and extending forwardly to a foremost portion thereof spaced just rearwardly of the depression portion, with the foremost portion of the arch portion preferably having an ogee-type cross-sectional configuration.

The heel portion and the arch portion of the insole insert are configured to form a channel there between with a first centrally located axis such that the first axis is laterally angularly offset from a second axis that substantially divides the insole insert into a medial half and a lateral half, and such that, during the supported phases of the user's gait, the normally greater weight-generated forces applied to the inner and more bony regions of the user's heel are cooperatively redistributed outwardly toward the outer and more fleshy regions of the user's heel.

Further, the bottom portion, the depression portion, the heel portion, and the arch portion are configured to cooperatively redistribute weight-generated forces operatively bearing against the sole of the user's foot such that greater weight-generated forces normally bearing against certain regions of the arch and forefoot of the user's foot are substantially reduced and redistributed toward other regions of the sole of the user's foot whereat smaller weight-bearing forces normally bear against the sole of the user's foot.

PRINCIPAL OBJECTS AND ADVANTAGES OF THE INVENTION

The principal objects and advantages of the present invention include: providing a device for insertion into existing footwear; providing such a device that is tailored to the biomechanical operation of the wearer's foot; providing such a device for properly supporting and cushioning various regions of the wearer's foot; providing such a device that redistributes weight-generated forces applied to the sole of the wearer's foot whereby the range of such forces is substantially reduced; providing such a device wherein arch and heel portions thereof are configured to cooperatively redistribute normally greater weight-generated forces bearing against the bony central region of the heel outwardly toward the larger, more fleshly outer regions of the heel to thereby substantially reduce the range of weight-generated forces normally applied to the heel regions of a user's foot; providing such a device wherein contoured portions thereof are configured to cooperatively redistribute normally greater weight-generated forces bearing against the heel, arch, and forefoot regions of a user's foot to other regions of the user's foot to which substantially smaller weight-generated forces are normally applied; and generally providing such a device that is efficient in operation, reliable in performance, and is particularly well adapted for the proposed usage thereof.

Other objects and advantages of the present invention will become apparent from the following description taken in conjunction with the accompanying drawings, which constitute a part of this specification and wherein are set forth exemplary embodiments of the present invention to illustrate various objects and features thereof.

BRIEF DESCRIPTION OF THE DRAWINGS

FIG. 2 is a top perspective view of an insole insert having certain contour features for a user's right foot, in accordance with the present invention.

FIG. 3 is a side elevational view along line 3—3 of FIG. 2 from the medial side of the insole insert.

FIG. 4 is a partially cross-sectional view of the insole insert, taken along line 4—4 of FIG. 3, according to the present invention.

DETAILED DESCRIPTION OF THE INVENTION

Figure 1:
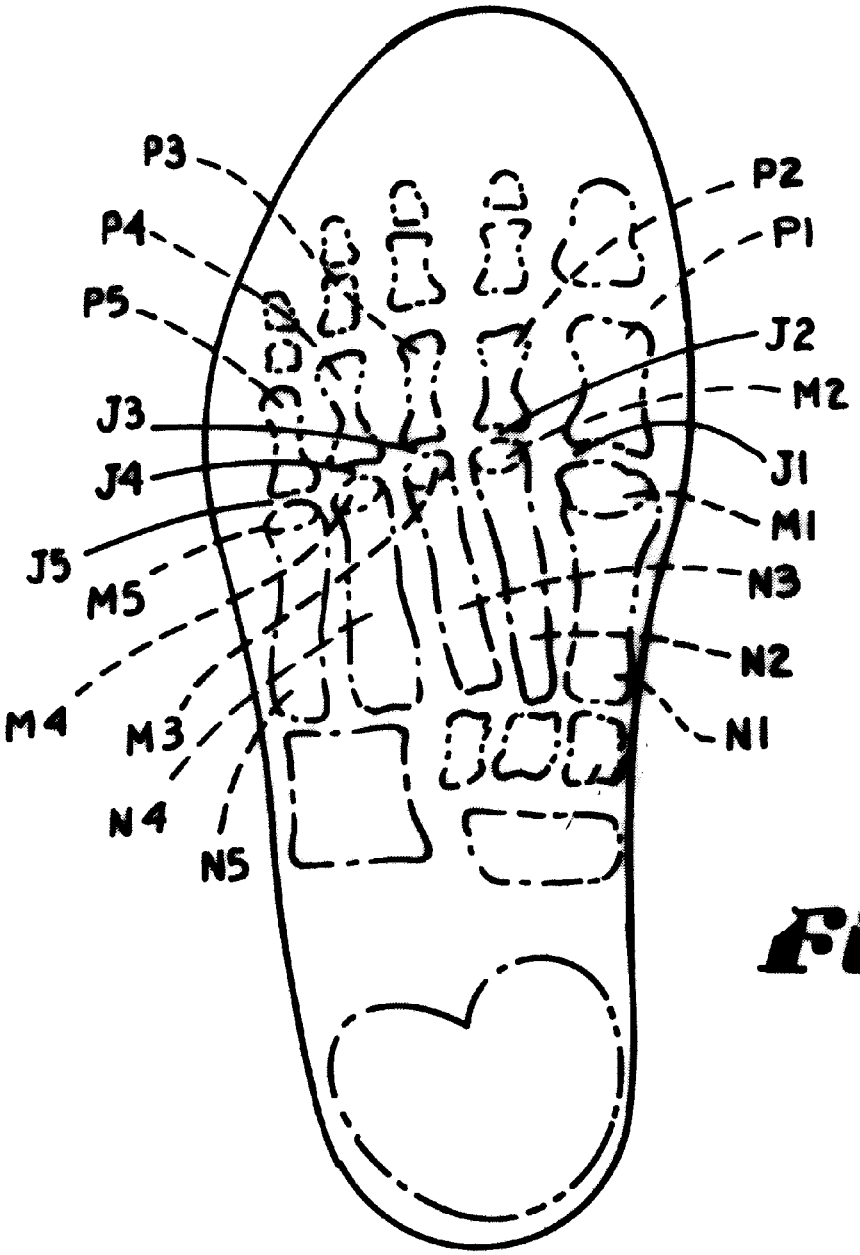
FIG. 1 is a schematic illustration, showing a top plan view of an insole of a left shoe and illustrating the approximate position of the metatarsal and related bone structure of a user's left foot in relation thereto.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to an insole insert in accordance with the present invention, as shown in FIGS. 2 through 4. The insole insert 1 generally comprises a body 7 having a contoured upper surface 13 for comfortable stable support of a wearer's foot and as hereinafter described, as indicated in FIG. 2, and a lower surface 15 for bearing against the insole of the wearer's shoe (not shown).

A common perimeter 17 defines the limits of both the upper surface 13 and the lower surface 15, and includes regions defined for purposes of reference herein as a toe edge 23, a heel edge 25, a medial side edge 27, and a lateral side edge 33 corresponding to parts of the user's foot. The length and width of any particular one (or pair) of the insole insert 1 may vary as is customary, depending upon the size of footwear for which that insole insert 1 is intended, and the overall depth or thickness of any particular one (or pair) of the insole insert 1 may also vary considerably, depending on the style of footwear into which the insole insert 1 is to be inserted. Also, at certain specific sites on the insole insert 1, the depth may vary as hereinafter described.

Various dimensions are quantified here below for exemplary purposes only; those quantities were observed for an insole insert 1 of the present invention for a child's size ten, oxford-type shoe, sometimes referred to herein as the "child's size-ten exemplary specimen". It is to be understood that those dimensions may increase or decrease according to the shoe size for which a particular set of the insole inserts 1 is to be utilized.

Continuing, the upper surface 13 may, if desired, be overlaid for style and/or comfort with a thin fabric layer or liner 35 or other suitable pliable sheet-like material, as shown in FIGS. 3 and 4, to separate the sole of the wearer's foot from direct contact with the upper surface 13 of the underlying insert body 7. For example, the layer 35 may be constructed of an elastomeric polymer cloth. In addition, the liner 35 may be made of an odor and/or moisture absorbing material, as known in the art, and may also be impregnated with an antibacterial and/or antimicrobial agent.

The material from which the body 7 of the insole insert 1 is molded or otherwise formed is preferably a pliable vinyl or other synthetic substance, such as those sometimes referred to as EVA (ethylene vinyl alcohol), PVA (polyvinyl alcohol), PU (polyurethane) or latex foam, polypropylene, etc., or other readily moldable substance which yields a relatively soft, pliable form once cured or "set". The material selected should be one that provides the desired cushioning, lightweightness, physical strength, wearability, rot resistance, slip resistance, is relatively durable with long use, and is preferably relatively inert and not commonly the cause of allergic reactions when in contact with skin. Preferably, the material selected is also one that is trimmable with a pair of scissors or shears for more precisely adapting, or custom fitting, the insole insert 1 to the footwear for which it is intended.

The body 7 generally has a Type C (commonly referred to as "Shore C Scale") durometer hardness measured in accordance with American Society of Testing and Material (ASTM) standard D 2440-97 of less than about 70, preferably a hardness in a range of about 40–65 and more preferably a hardness of approximately 55. Depending upon the particular activity for which the footwear is intended, however, the hardness may be greater or lesser as desired. For example, if the footwear is intended for walking, the body 7 may have a Type C durometer hardness (ASTM D 2240-97) of about 45, whereas if the footwear is intended for running, the body 7 may have a hardness of about 60. In short, the body 7 should be sufficiently "soft" to provide shock attenuation, but sufficiently firm to provide stability to the foot.

The insole insert 1 includes, preferably unitarily, a bottom portion 37, a depression area 43, a heel portion 45, and an arch portion 47. The bottom portion 37 has a front section 53, extending rearwardly from the toe edge 23 to approximately a foremost end 55 of the heel portion 45, and a rear section 57, extending from the front section 53 rearwardly to a rear portion 63 of the heel portion 45, as shown in FIG. 2 and as hereinafter described. Except for the depression area 43, the front section 53 has a generally uniform thickness, whereas the rear section 57 gradually increases in thickness rearwardly from the front section 53, such that the wearer's heel is positioned slightly above the wearer's forefoot.

For example, the front section 53 of the child's size-ten exemplary specimen of the insole insert 1 may have a uniform thickness of approximately 5/64 inch, whereas the rear section 57 thereof gradually increases in thickness from approximately 5/64 inch at the juncture between the rear section 57 and the front section 53 to a thickness of approximately 1/8 inch at a center of curvature 65 of the boundary between the heel portion 45 and the bottom portion 37. The slightly upwardly and rearwardly sloping aspect of the rear section 57 of the bottom portion 37 reduces the upward pull on the wearer's calcaneus to thereby reduce the strain on his intrinsic or interior foot muscles and to reduce or eliminate the incidence of plantar fascial tears including the heel pain associated therewith.

The depression area 43 is configured to permit the user's first metatarsal-phalangeal joint J1 to move vertically downwardly while walking. The depression area 43, which is generally located in the bottom portion 37 such that the user's first metatarsal-phalangeal joint J1 is spaced approximately centrally there over, is configured to have sufficient horizontal dimensions to properly accommodate the user's paired sesamoid bones located beneath his first metatarsal joint J1 to thereby allow proper, natural flexion of the user's metatarsal phalangeal joints despite the user's foot being confined to an article of footwear.

More specifically, the depression area 43 permits the first metatarsal phalangeal joint J1 to be displaced more naturally relative to the adjacent metatarsals to promote increased stability and greater balance to the extrinsic musculature of the foot and to minimize or eliminate the incidence of saddle joint deformity. The depression area 43 is also configured to basically cup the first metatarsal phalangeal joint J1 to thereby essentially lock the support provided by the insole insert 1 securely in the footwear against the child's moldable foot and, additionally, to prevent forward slippage of the user's foot in the footwear.

For example, the depression area 43 of the child's size-ten exemplary specimen of the insole insert 1 may has a depth of approximately 1/32 inch or approximately forty percent of the thickness of the front section 53, a width of approximately fifty percent of the overall width of the insole insert 1, and a fore-to-aft dimension of approximately twenty percent of the overall length of the insole insert 1. Preferably, the depression area 43 includes a perimetral edge 67 that tapers or slopes from the upper surface 13 to a floor 73 of the depression area 43, as shown in FIG. 2. For example, the perimetral edge 67 of the child's size-ten exemplary specimen of the insole insert 1 may have a horizontal width of approximately 1/8 inch.

It is to be understood that the depression area 43 may be approximately circular, as suggested in FIG. 2, or rectangular, triangular, oval, or any other suitable shape so long as the depression area 43 is properly dimensioned to, cooperatively with other components of the insole insert 1, accomplish desired foot functioning and redistribution of the weight-generated forces bearing against the sole of the user's foot during the various phases of gait as described herein. In general, the depression area 43 can be generally described as having a broad, relatively flat shape with the floor 73 having a generally uniform thickness.

The heel portion 45 and the arch portion 47 are configured and dimensioned to cooperatively redistribute relatively large weight-generated forces bearing against certain areas of the sole of the user's foot, that are normally induced during various supported phases of the user's gait, to other areas of the user's sole that normally experience smaller, weight-generated forces to thereby substantially reduce the range of such forces bearing against the sole of the user's foot. To accomplish such redistribution of weight-generated forces, the rear portion 63 and a lateral portion 75 of the heel portion 45 extend inwardly from the perimeter 17 such that the portion of the bottom portion 37 exposed to the user's heel and arch is substantially reduced from that provided by prior art insoles. In other words, weight-bearing forces bearing against the sole of the user's foot are shifted outwardly from the more bony structure of the user's heel toward the larger and more fleshy areas of the user's heel and arch.

For example, the horizontal width of the heel portion 45 of the child's size-ten exemplary specimen of the insole insert 1 may have a horizontal width in the range of approximately five to eight percent of the overall length of the insole insert 1, and/or in the range of approximately sixteen to twenty-one percent of the overall width of the insole insert 1.

Each of the rear portion 63 and the lateral portion 75 of the heel portion 45 has a generally triangular configuration where they extend above the rear section 57 of the bottom portion 37 such that the rear portion 63 and the lateral portion 75 taper downwardly and inwardly from the perimeter 17 to the rear section 57 to form a generally semicircular boundary 77 about the center of curvature 65 between the heel portion 45 and the rear section 57. If desired, the inner edges of the rear portion 63 and lateral portion 75 may be spaced slightly above the rear section 57 in order to form a relief, as indicated by the dashed line designated by the numeral 79 in FIG. 2, to thereby facilitate minimal shifting of flesh of the user's sole to assist with accommodation of the redistribution of weight-generated forces from the rear section 57 to the heel portion 45 and the arch portion 47.

Further, the lateral portion 75 of the heel portion 45 extends forwardly along the lateral side edge 33 to terminate just rearwardly of the fifth metatarsal phalangeal joint J5. For example, the lateral portion 75 of the heel portion 45 of the child's size-ten exemplary specimen of the insole insert 1 generally extends forwardly to approximately fifty-five to sixty percent of the overall length of the insole insert 1.

Similarly to the heel portion 45, the arch portion 47 extends inwardly from the perimeter 17, oppositely from the lateral portion 75 of the heel portion 45, such that only a relatively narrow corridor 83 of the bottom portion 37 is exposed to the user's heel and arch, to thereby, in conjunction with the heel portion 45, redistribute weight-generated forces from the rear section 57 to the heel portion 45 and the arch portion 47, or toward the outer portions of the user's heel that normally experience smaller weight-generated forces. In other words, the heel portion 45, in conjunction with the arch portion 47, is configured to redistribute the weight-generated forces from the center of the user's heel outwardly to thereby reduce or eliminate the incidence of bruising of the bottom center of the user's heel.

In addition, the heel portion 45 and the arch portion 47 are cooperatively configured such that body weight of the user is distributed over a larger area of the sole of the user's foot. Due to the configuration of the heel portion 45 and the arch portion 47, the user's foot is supported at an elevation slightly above the elevation at which it would otherwise be supported were it not for the heel portion 45 and the arch portion 47. As a result, the larger weight-generated forces normally applied to the user's arch are redistributed toward areas of the user's arch that are normally subjected to much smaller or no weight-generated forces.

Further, the cooperative configuring of the heel portion 45 and the arch portion 47, wherein the user's foot is supported at a slightly higher elevation within footwear as hereinbefore described, in further cooperative configuring of the depression area 43, also redistributes the larger weight-generated forces normally applied to the user's forefoot toward areas of the user's forefoot that are normally subjected to much smaller weight-generated forces.

The corridor 83 is approximately symmetrically arranged about an axis 85 radiating generally forwardly from the center of curvature 65. The insole insert 1 may also be described as being approximately symmetrically arranged about another axis 87, also radiating generally forwardly from the center of curvature 65, with the axis 87 approximately dividing the insole insert 1 into a lateral half 91 and a medial half 93 and generally passing (i) through a point 95 at the center of a transverse line at the rear of the depression area 43, and (ii) alongside the depression area 43, as shown in FIG. 2. The axis 85 is generally laterally spaced from the axis 87 by an angular offset 97.

The arch portion 47 extends above the rear section 57 of the bottom portion 37 and, except for a foremost portion 99 thereof, gently arcuately tapers downwardly and inwardly from the perimeter 17 to grade into the rear section 57 to thereby form a medial boundary 103 of the corridor 83. The foremost portion 99 of the arch portion 47 can be generally described as having an ogee-type cross-sectional configuration, as indicated by the numeral 105 in FIG. 4.

The arch portion 47 generally grades into the rear portion 63 of the heel portion 45 and extends forwardly along the medial side edge 27 to terminate just rearwardly of the depression area 43 and, generally, slightly forwardly from the foremost end 55 of the heel portion 45. In other words, the arch portion 47 also extends forwardly to approximately fifty-five to sixty percent of the overall length of the insole insert 1. The underside of the arch portion 47 may be hollowed out, as indicated by the dashed line designated by the numeral 107 in FIG. 4, to further promote lightweightness of the insole insert 1.

The arch portion 47, in conjunction with the depression area 43, is configured to permit weight-generated forces to be more naturally distributed between the user's arch and the various metatarsals to thereby minimize or eliminate the incidence of tibial sesamoiditis. Further, the arch portion 47 and the depression area 43 are configured such that cooperative interaction therebetween reduces first ray instability by supporting the talonavicular joint which, in turn, reduces the stress on adjacent metatarsals thereby decreasing or eliminating the incidence of metatarsal stress fractures. Also, the arch portion 47 is configured to promote more natural control of the talonavicular joint to thereby decrease or eliminate the incidence of shin splints and fatigue of the front and back leg muscles, and to thereby promote more efficient movement of the user's lower leg muscles.

As an example of dimensions for the heel portion 45 and the arch portion 47 of the child's size-ten exemplary specimen of the insole insert 1, the width of the corridor 83 at the center of curvature 65 thereof and continuing approximately 3.5 cm forwardly therefrom may be approximately 2.5 cm; the horizontal width of the lateral portion 75 of the heel portion 45 and the height of the perimeter 17 transversely from the center of curvature 65 may be approximately 1.0 cm and 0.8 cm, respectively; the horizontal width of the rear portion 63 of the heel portion 45 and the height of the perimeter 17 directly rearwardly from the center of curvature 65 may be approximately 1.3 cm and 0.8 cm, respectively; the horizontal width of the arch portion 47 and the height of the perimeter 17 transversely from the center of curvature 65 may be approximately 1.4 cm and 1.2 cm, respectively; the horizontal width of the arch portion 47 and the height of the perimeter 17 at the highest point of the arch portion 47 may be approximately 2.2 cm and 1.6 cm, respectively; and the angular offset 97 between the axes 85, 87 may be approximately five degrees.

The structural and contour features of the upper surface 13, namely the depression area 43, the heel portion 45, and the arch portion 47 are configured to cooperatively provide the insole insert 1 with the ability to permit a user's foot to be secure and stable as necessary for appropriate flexing and movement of the bone structure throughout the phases of gait in most existing footwear that do not otherwise provide such security and stability. As an added benefit of the insole insert 1, the bottom portion 37, the depression area 43, the heel portion 45, and the arch portion 47 are configured such that cooperative interaction thereamong largely minimizes or eliminates excessive inward rotation of the user's leg to thereby reduce knee and hip discomforts sometimes associated therewith. Further, and particularly for users having flat feet, the bottom portion 37, the depression area 43, the heel portion 45, and the arch portion 47 are configured such that cooperative interaction thereamong will more naturally balance the extrinsic muscles on the top and bottom of the user's foot to thereby minimize or entirely eliminate the maladies commonly referred to as bunions and hammertoes.

A state-of-the-art system, developed for measuring the distribution of weight-generated forces applied to the sole of a user's foot, sometimes referred to as "F-scan in-shoe gait analysis", was used to evaluate the inventive features of the insole insert 1 of the present invention. The F-scan system uses paper-thin insole devices, each approximately 0.007-inch thick and containing on the order of a thousand individual sensors. The F-scan insole devices are flexible and trimmable to custom fit almost any shoe size or shape, including children's shoes. During evaluations, the F-scan insoles are attached directly to the bottom of a sock or the skin of a child's sole before insertion into footwear. The bi-pedal plantar pressures at each of the sensors are then detected, monitored, and recorded by the F-scan system as they sequentially occur during a normal gait cycle and/or during stance. The results may then be compared with similar measurements taken with the same or similar footwear, one set with modifications such as the insole insert 1, and one set without such modifications.

In regard to the present invention, F-scan computerized gait analysis system was used for diagnostic evaluations of footwear not providing the benefits of the insole insert 1 and compared with corresponding diagnostic evaluations of footwear utilizing the insole insert 1 of the present invention. The comparison of the sets of analyses disclosed that the larger weight-generated forces normally applied to localized regions of the user's foot sole were indeed redistributed toward other regions of the user's foot sole normally experiencing smaller weight-generated forces to thereby substantially reduce the range of applied weight-generated forces.

In an application of the present invention wherein the insole insert 1 is appropriately installed in existing footwear and worn on a user's foot, some of the primary benefits provided by the insole insert 1 while walking and running begin at heel strike, when the heel of the user's footwear first hits the underlying supporting surface. The resiliency of the lateral portion 75 of the heel portion 45 of the insole insert 1, in addition to cooperatively redistributing weight-generated forces applied to the user's foot as described herein, also provides cushioning for those initial impacts to thereby reduce risk of injury to the user and to thereby support and promote enhanced efficiency of other associated parts of the user's foot and lower skeletal structure.

After each such initial impact, the user's foot pivots distally about his heel, with the lateral sides of his arch and forefoot impacting against the underlying supporting surface and the his foot pronating to a neutral position with the central vertical plane of his heel generally appropriately oriented perpendicularly to the underlying supporting surface. Again, resiliency of the arch portion 47 and the front section 53 of the bottom portion 37 of the insole insert 1 provides cushioning for the shocks arising from such secondary impacts. As the user's metatarsal phalangeal joints shift downwardly, the first metatarsal phalangeal joint stabilizes as it must before the user's foot subsequently lifts from the underlying supporting surface. The lesser phalangeal joints are accordingly stabilized due to the contours of the insole insert 1 as herein described, including the depression area 43 for the first metatarsal phalangeal joint J1.

The resiliency of the front section 53 of the bottom portion 37 beneath the user's metatarsal heads M1–M5 also serves to redistribute weight-generated forces thereagainst during mid-stance through propulsive phases of his gait cycle. The described motion places the user's foot in an appropriate biomechanical position for the propulsive phase of his gait cycle, including proper displacing of his sesamoid apparatus during mid-stance and toe-off phases. In addition, the cooperative interaction by the heel portion 45 and the arch portion 47, whereby the user's foot is fully supported slightly above the elevation that the user's foot would otherwise be supported were it not for the heel portion 45 and the arch portion 47, allows the sesamoids and certain muscles of the user's foot to momentarily rest to thereby create a desirable timing sequence thereof and, cooperatively with the depression area 43, to create a more effective lever system just prior to the foot progressing into the toe-off phase of his gait.

As the user's foot rotates forwardly into the toe-off phase, the first metatarsal M1 is permitted by the insole insert 1 to be appropriately pushed downwardly, remaining stable as the user's heel lifts from the underlying supporting surface, and continuing to remain stable and appropriately flex without forward slippage up to the position in the user's gait whereat the first metatarsal phalangeal joint J1 lifts from the underlying supporting surface. In other words, as the user's heel lifts from the underlying supporting surface, the insole insert 1 allows the user's first metatarsal phalangeal joint J1 to actually displace downwardly to continue to be stabilized, thereby progressively providing appropriate functioning of the user's foot throughout the entire supported phases of his gait.

One of the primary reasons the user's foot remains stable throughout the supported phases of his gait is because the structure of the insole insert 1 provides support and stability for each of the user's heel, arch, and first metatarsal from before the user's foot rotates forwardly, whereat his heel would lift from the underlying supporting surface, to the point in the user's gait whereat the user's first metatarsal actually lifts from the underlying supporting surface. Thus, the insole insert 1 appropriately provides all of the necessary supporting and stabilizing factors. By providing the inventive structure in one, unitary insole insert, the user's foot can function appropriately within the confines of his shoe.

In other words, the insole insert 1 is adapted to support and maintain the heel in a perpendicular orientation relative to the underlying supporting surface, to thereby support the longitudinal arch of the foot by shifting the weight laterally, to provide a larger surface area to balance the child's weight as well as to provide a more even distribution of weight-generated forces applied to the sole of his feet, and to allow his foot to function more efficiently by allowing the first metatarsal phalangeal joint and associated sesamoid apparatus to function properly.

It should now be obvious from the foregoing that the material properties of the various regions of the insole insert 1 appropriately cushion, support and stabilize the various parts of the user's foot as herein described. It should also now be obvious that the resiliencies hereinbefore described may be altered, depending upon the intended use of the footwear for which the insole insert 1 is intended. For example, adult footwear designed for use in situations where the wearer will frequently be carrying a heavy load (e.g., work boots) may require more support than a child's dress shoe. Likewise, footwear made for running may require firmer support in the heel section to thereby absorb the greater initial shock of each running step than would a hiking boot in which more cushioning may be desired for each walking step. Further, it will be appreciated that the present invention is not limited necessarily to any particular type of footwear and may be equally desirable for use in shoes, boots and sandals. In addition, it should be understood that the locations and phases of the areas of softer and harder material may be altered without departing from the scope of this invention.

Preferably, use of the insole insert 1 of the present invention will be initiated as soon as the infant's feet become weight-bearing to thereby aid the child in standing and walking, to mold the child's foot into an appropriate position that does not interfere with the foot's normal ontogenetic development, and to provide substantially full and complete support between the child's foot and the underlying supporting surface.

It is to be understood that the invention described herein is not to be limited to footwear for children but, in many cases, may be equally applicable to insole inserts for adult footwear and that, while certain forms of the present invention have been illustrated and described herein, it is not to be limited to the specific forms or arrangement of parts described and shown.

What is claimed and desired to be secured by Letters Patent is as follows:

1. An insole insert for a user's footwear, said insole insert comprising:

(a) a body having a toe edge, a heel edge, a lateral side edge, a medial side edge, and a bottom portion, wherein said bottom portion includes:

(1) a front section extending rearwardly from said toe edge to just rearwardly from the metatarsal phalangeal joints of the user, said front section having a substantially uniform thickness, and (2) a rear section extending rearwardly from said front section to substantially said heel edge, said rear section having substantially the same thickness as the front section at a juncture therewith and gradually increasing in thickness rearwardly from said front section;

(b) a depression area formed in the front section of said body and spaced generally centrally beneath the first metatarsal phalangeal joint of the user, said depression area having a tapered perimetral edge;

(c) a heel portion formed along said heel edge and said lateral side edge, said heel portion being raised above said bottom portion of said body and sloping downwardly to said rear section of said bottom portion, said heel portion extending forwardly to a foremost end thereof spaced just rearwardly of the user's fifth metatarsal phalangeal joint; and (d) an arch portion formed along said medial side edge, said arch portion being raised above said bottom portion of said body and sloping downwardly to said rear section of said bottom portion, said arch portion extending forwardly to a foremost portion thereof spaced just rearwardly of said depression area, said arch portion narrowing as the arch portion extends towards said foremost portion and terminating just rearwardly of said depression area; and (e) said heel portion and said arch portion defining a substantially planar channel there between on said bottom portion of said body.

* * * * *